United States Patent [19]

Duffy

[11] Patent Number: 5,022,290

[45] Date of Patent: Jun. 11, 1991

[54] ADJUSTABLE LOCKING WRENCH

[76] Inventor: Thomas F. Duffy, Box 320, R.D. 1, Owego, N.Y. 13827

[21] Appl. No.: 583,500

[22] Filed: Sep. 17, 1990

Related U.S. Application Data

[63] Continuation of Ser. No. 7,516, Jan. 28, 1987, abandoned, which is a continuation of Ser. No. 833,557, Feb. 27, 1986, abandoned.

[51] Int. Cl.[5] ..... B24B 7/04

[52] U.S. Cl. ..... 81/355; 81/359; 81/367

[58] Field of Search ..... 81/367–380, 81/355, 357, 359, 364, 358, 145, 142, 129, 129.5, 131; 269/6, 210, 211, 212, 215, 214

[56] References Cited

U.S. PATENT DOCUMENTS

| | | | |
|---|---|---|---|
| 1,364,600 | 1/1921 | Woods . | |
| 1,384,765 | 7/1921 | Knitter . | |
| 2,377,612 | 6/1945 | Clark | 81/376 |
| 2,524,689 | 10/1950 | Westman | 81/378 |
| 2,905,038 | 9/1959 | Paden | 81/380 |
| 3,672,245 | 6/1972 | Hoffman | 81/367 |

*Primary Examiner*—Maurina Rachuba

*Attorney, Agent, or Firm*—Richard G. Stephens

[57] ABSTRACT

A locking plier-wrench includes a first handle member having a first jaw member lockable at a plurality of positions relative to the handle member and removable from the handle member so that a different jaw member having a different length shank may be substituted, and a second jaw member pivotally mounted on the handle member and straddling the handle member.

7 Claims, 2 Drawing Sheets

ADJUSTABLE LOCKING WRENCH

This application is a continuation of my co-pending Application Ser. No. 007,516 filed Jan. 28, 1987, now abandoned which, in turn, is a continuation of Application Ser. No. 833,557 filed Feb. 27, 1986, now abandoned. My invention relates to hand tools, and more particularly, to an improved form of locking plier-wrench. Locking plier-wrenches are well known and widely used. A particularly popular line of such wrenches is marketed under the trademark "Vise-Grip".

The following prior art patents may be of interest:

| | | | |
|---|---|---|---|
| 351,656 | 800,814 | 967,651 | 1,196,900 |
| 2,320,303 | 2,417,013 | 2,500,462 | 2,545,355 |
| 2,691,317 | 2,905,038 | 3,608,405 | |

Those adjustable locking plier-wrenches with which I am familiar have an undesirably limited range of jaw adjustment. A primary object of the present invention is to provide a locking plier-wrench having a much larger range of jaw adjustment, so that such a tool can be used to grasp a much larger range of sizes of objects, or workpieces.

Other objects of the invention will in part be obvious and will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which.

Figure 1:
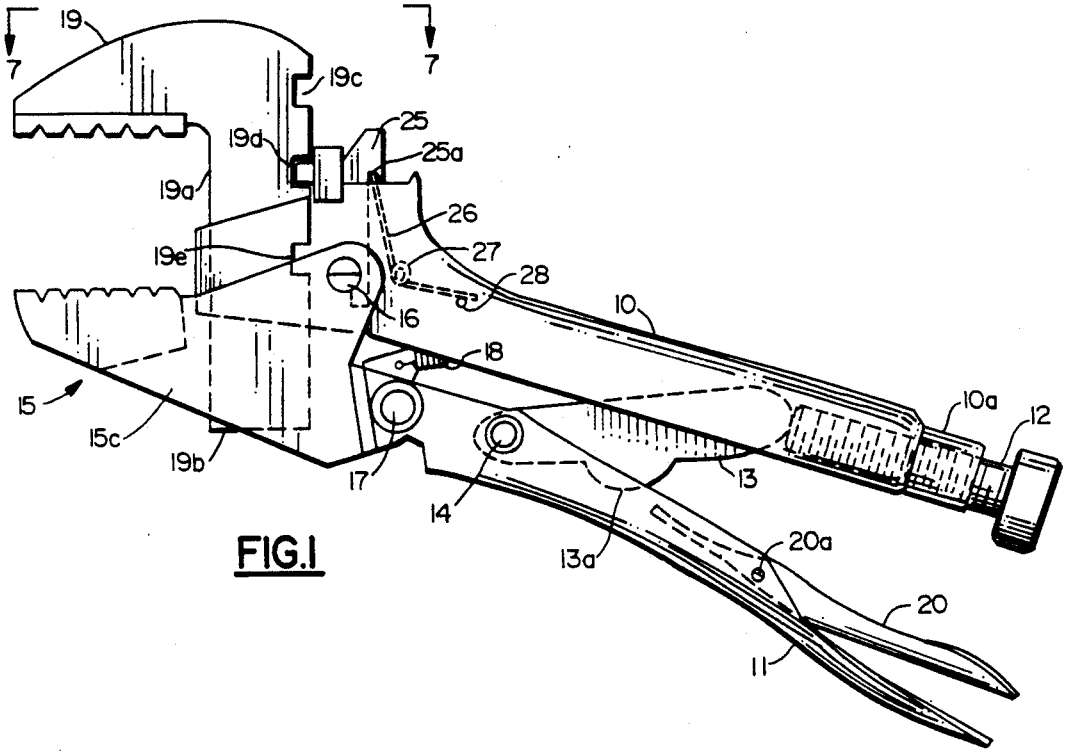
FIG. 1 is a side elevation view of a preferred form of the invention, with certain parts shown in phantom, and with an upper jaw member adjusted at one position relative to the remainder of the plier-wrench.

Referring now to FIG. the plier-wrench is shown as comprising an upper handle member 10 and a lower handle member 11. Upper handle member 10 is internally threaded at 10*a* to receive an adjustment bolt 12. A link 13 pivotally journalled at 14 in lower handle member 11 extends into upper handle member 10 to abut the end of bolt 12. A lower jaw member 15 is pivotally attached to the upper handle member at 16 and pivotally attached to the lower handle member at 17. A tension spring 18 connected between lower jaw member 15 and upper handle member 10 urges lower jaw 15 clockwise (as viewed in FIG. I) about pivotal connection 17. As handle members 10 and 11 are moved toward each other, link 13 pivots at the point where it engages bolt 12, so that pivot pin 14 moves along a clockwise arc, and pivot 17 moves forwardly, pivoting lower jaw member clockwise about pivot pin 16 and stretching tension spring 18. When the pivot pin at 14 reaches a line extending between pivot pin 17 and the point where link 13 engages bolt 12, the wrench passes through a dead-center position, and thereafter to a locked limit position wherein a portion 13*a* of link 13 seats against lower handle member Lever 20, which is pivotally attached to lower handle member 11 at 20*a*, may be actuated to urge link 13 counterclockwise to unlock the wrench. As thus far described the locking plier-wrench of FIG. 1 does not differ in material principle from a known "Vise-Grip" brand of locking plier wrench.

In accordance with one concept of the present invention, an upper jaw member 19 is adjustably positioned relative to upper handle member 10 via a detent mechanism to be described. Secondly, pivotal lower jaw member 15 is provided at least with a recess which will accommodate a portion of the shank 19*a* of adjustable upper jaw member 19, and preferably with a through-slot so that portions of the shank 19*a* of upper jaw member 19 can extend entirely through and protrude below lower jaw member 15.

Figure 2:
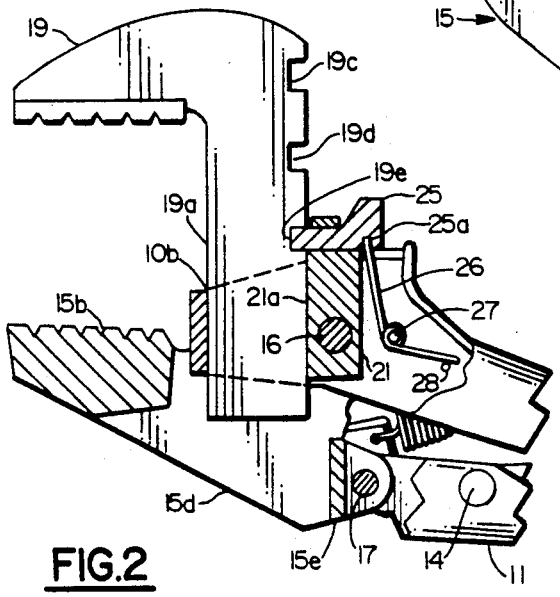
FIG. 2 is a partial view elevation generally similar to that of FIG. 1 except that the upper jaw member is shown adjusted to a different position relative to the remainder of the plier wrench and certain portions of an upper arm member and a lower jaw member are shown cutaway.
Figure 3:
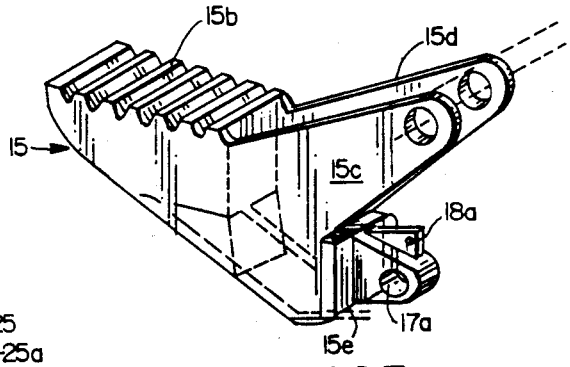
FIG. 3 is an isometric view of a preferred form of lower jaw member.

As shown in FIG. 3, lower jaw member 15 comprises a piece 15*e* having a bore 17*a* near its rear end through which pivot pin 17 passes and a hole 18*a* which receives an end of tension spring 18. Lower jaw member 15 also includes a pad 15*b* shown having teeth formed thereon, and importantly, a pair of spaced-apart arm portions 15*c* and 15*d* extending rearwardly from the pad and situated on opposite sides of upper handle member 10. Piece 15*e* ties together the rear ends of arm members 15*c*, 15*d*. As seen in FIG. 2, pad 15*b* and piece 15*e* are spaced sufficiently far apart that neither will extend below slot 10*b* as lower jaw member 15 is rotated between its two opposite rotational limits. In FIG. 1 a small portion of shank 19*a* is shown at 19*b* protruding below the arm portions.

Figure 5:
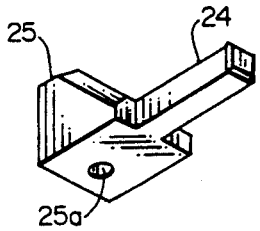
FIGS. 5 and 6 are isometric views illustrating portions of a detenting mechanism provided to allow adjustment of either upper jaw member relative to the remainder of the locking plier-wrench.
Figure 6:
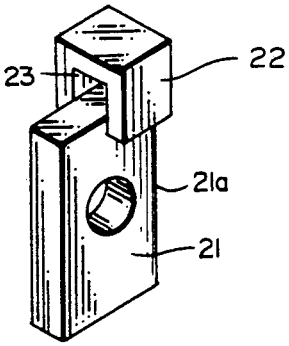
Figure 8:
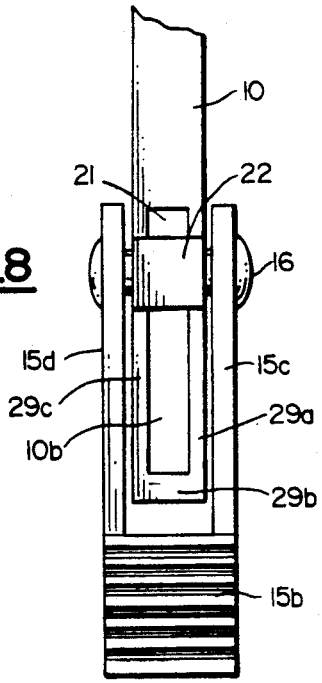
FIG. 8 is a view similar to FIG. 7 with upper jaw member 19 and detent member 25 removed.

As best seen in FIGS. 2, 6 and 8, the forward end of upper handle member 10 includes means consisting of side portions 29*a*, 29*b*, 29*c* and 21*a*, defining a rectangular guide slot 10*b* through which the shank 19*a* of upper jaw 19 may be adjustably slidably positioned when detent means to be described are released. Upper jaw member 19 is shown provided with three detent notches 19*c*, 19*d*, 19*e* on its rear edge. A block 21 affixed to and forming a front part of upper handle member 10 and the rear edge 21*a* of slot 10*b* carries an integral hood portion 22 (FIG. 6), providing a through slot 23 through which a finger 24 (FIG. 5) of detent member 25 may slide. A wound spring 26 journalled at 27 in upper arm 10 extends between a recess 25*a* in detent member 25 and bears against a pin 28 extending through upper arm 10, thereby urging the detent member 25 leftwardly (as viewed in FIGS. 1 and 2) against the rear edge of the shank 19*a* of upper jaw member 19.

It will be apparent at this point that by pulling detent member 25 rightwardly (as viewed in FIG. I or FIG. 2)

against the force of spring 26, the operator may remove the end of finger 24 from any one of notches 19*c*–19*e*, slide upper jaw 19 up or down, and then release member 25 so that finger 24 extends into a different one of the notches. Hence, by use of the described detent arrangement the operator may selectively fix upper jaw 19 at any one of a plurality of discrete positions relative to upper arm 10. The operator may place finger 24 in notch 19*c* to grasp very small objects, or in notch 19*d* to grasp somewhat larger objects, or in notch 19*e* to grasp still larger objects. It may be noted that use of the detent mechanism to select a given position of upper jaw 19 relative to upper handle member 10 in no way affects the pivotal movement of lower jaw member 15 as handle members 10 and 11 are squeezed together, nor does it affect the relative position of handle members 10, 11 at which "over-centering" occurs.

Figure 4:
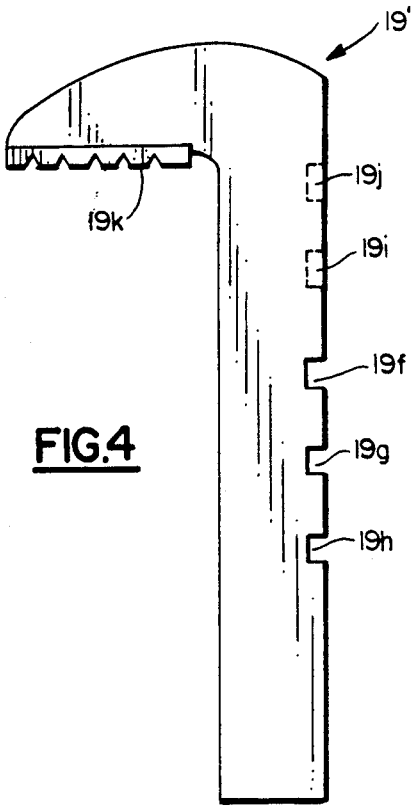
FIG. 4 is a side elevation view of a second form of upper jaw member which may be substituted into the wrench of FIGS. 1 and 2 in place of the upper jaw member shown therein.
Figure 7:
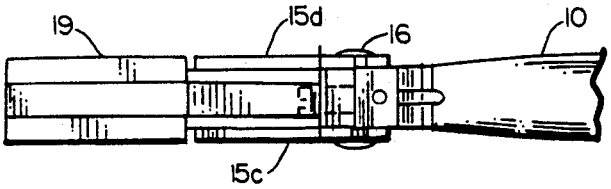
FIG. 7 is a top view of a portion of the wrench, taken at lines 7—7 in FIG. 1.

If the upper jaw member 19 of FIGS. 1 and 2 will not accept a larger workpiece of desired size, the operator may pull detent member 25 rightwardly, entirely remove upper jaw member 19 from the wrench, and then substitute a different upper jaw member, such as that shown at 19' in FIG. 4, which has a longer shank and detent notches 19*f*–19*j* spaced at different distances along its shank from its face or working surface 19*k*.

A variety of upper jaw members having shanks of different lengths may be provided to handle a large range of sizes of workpieces. It may be noted that the detent notches for jaw members 19 and 19' have been shown situated at the same distances from the lower ends of their respective shanks. That will insure that only a modest amount of the shank will protrude through lower jaw member 15 and out the bottom of the wrench when the detent member engages the upper most notch. If a long length of shank protrudes from the bottom of the wrench, that may interfere with movement of the wrench in various crowded workspaces. However, in some uses workspace is not a problem, and accordingly upper jaw members of the nature of that shown in FIG. 4 may include added detent notches, such as those shown in dashed lines at 19*i*, 19*j* in FIG. 4. With added detent notches provided along the shank of the upper jaw, the user can operate on a larger range of sizes of workpieces without having to substitute a different upper jaw, assuming sufficient workspace exists. The use of very many detent notches along the shank of an upper jaw does tend to weaken the jaw, of course.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. A locking wrench, comprising, in combination: a first handle member having a guide slot, said guide slot extending through a first end of said first handle member with four mutually interconnected side portions bounding said guide slot; a first jaw member having an elongated shank and a jaw pad portion extending from one end of said shank, said jaw pad portion having a jaw face and said elongated shank being slidably mounted in said guide slot, said shank being continuously bounded on four sides by said mutually interconnected side portions, which continuously bound said guide slot; a second jaw member pivotally mounted on said first handle member; a second handle member pivotally connected to said second jaw member; a link having its ends pivotally engaging said first and second handle members, with means for continuously adjusting the point at which one of the ends of said link pivotally engages one of said handle members; and releasable locking means carried on said first handle member for engaging said shank to allow said jaw face to be indexed to and fixed at a plurality of predetermined discrete spaced-apart positions outwardly from and beyond said guide slot while said shank remains at all times continuously bounded and supported by said mutually interconnected side portions, and to allow said first jaw member to be slidingly removed from said first handle member and replaced by a different jaw member having a shank of different length, said second jaw member having a recess into which the other end of said shank may extend.

2. The wrench of claim 1 wherein said shank has a plurality of spaced apart notches and said releasable locking means comprises spring-operated detent means operable to engage selected ones of said notches.

3. The wrench of claim 1 wherein recess in said second jaw member extends entirely through said second jaw member, whereby portions of said shank may extend entirely through said second jaw member.

4. The wrench of claim wherein said second jaw member comprises a work-engaging pad and a pair of spaced apart side plate portions extending rearwardly from said pad and pivotally connected to said first handle member on opposite sides of said first handle member, with a connecting pin located behind said guide slot of said first handle member, space between said side plate portions providing said recess.

5. The wrench of claim I wherein the length of said elongated shank exceeds the length of said guide slot of said first handle member.

6. The wrench of claim 4 having a tie member interconnecting rear portions of said side plate portions, with space between providing said recess which is continuously bounded on four sides by said tie member, said side plates, and said work-engaging pad; with said second handle member being pivotally connected to said tie member.

7. The wrench of claim 1 having a third jaw member having a shank of different length than said first jaw member for use as said different jaw member.

* * * * *